US006945816B1

(12) United States Patent
Wu

(10) Patent No.: US 6,945,816 B1
(45) Date of Patent: Sep. 20, 2005

(54) FLOATING PANEL MOUNT CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/959,564

(22) Filed: Oct. 5, 2004

(51) Int. Cl.[7] ..... H01R 13/73
(52) U.S. Cl. ..... 439/545; 439/552
(58) Field of Search ..... 439/545, 552, 439/557, 559

(56) References Cited

U.S. PATENT DOCUMENTS

| | | | | |
|---|---|---|---|---|
| 4,389,021 | A * | 6/1983 | Coldren | 439/545 |
| 5,004,430 | A * | 4/1991 | DelGuidice et al. | 439/350 |
| 5,334,049 | A * | 8/1994 | Kachlic et al. | 439/567 |
| 5,613,876 | A * | 3/1997 | Sakatani et al. | 439/552 |
| 5,800,208 | A * | 9/1998 | Ishizuka et al. | 439/557 |
| 5,868,586 | A * | 2/1999 | Maejima | 439/567 |
| 5,967,839 | A * | 10/1999 | Uchida | 439/557 |
| 5,975,930 | A * | 11/1999 | Matsuura et al. | 439/157 |
| 5,980,291 | A * | 11/1999 | Ono | 439/247 |
| 6,017,233 | A | 1/2000 | Fry | |
| 6,036,510 | A * | 3/2000 | Ono et al. | 439/157 |
| 6,039,612 | A * | 3/2000 | Brown et al. | 439/716 |
| 6,176,738 | B1 * | 1/2001 | Consoli et al. | 439/545 |
| 6,210,215 | B1 | 4/2001 | Hwang | |
| 6,210,217 | B1 * | 4/2001 | Ping | 439/557 |
| 6,312,285 | B1 * | 11/2001 | Berg et al. | 439/545 |
| 6,332,806 | B1 * | 12/2001 | Yasui et al. | 439/545 |
| 6,343,944 | B1 * | 2/2002 | Okabe | 439/157 |
| 6,428,353 | B2 * | 8/2002 | Mochizuki | 439/545 |
| 6,439,909 | B1 * | 8/2002 | Polgar et al. | 439/248 |
| 6,547,591 | B2 * | 4/2003 | Okabe et al. | 439/557 |
| 6,796,815 | B2 * | 9/2004 | Okabe et al. | 439/157 |

* cited by examiner

*Primary Examiner*—Ross Gushi
*Assistant Examiner*—Larisa Tsukerman
(74) *Attorney, Agent, or Firm*—Wei Te Chung

(57) ABSTRACT

A connector assembly (100) adapted to be mounted onto a panel (8) includes a housing (1) having a number of keys (107, 108) on exterior surfaces thereof, a number of contacts (2) received in the housing, and a fixing pusher (6) attached to the housing along a first direction. The fixing pusher includes a finger operable main body (60) and a forwardly extending filling bar (61). The keys are adapted to pass through the panel along the first direction and engage with the panel after a movement of the housing relative to the panel along a second direction perpendicular to the first direction. The main body of the fixing pusher is directly pushed by a user to bring the filling bar into engagement with the panel, and thus, safely mounts the connector assembly onto the panel in a floating manner.

18 Claims, 14 Drawing Sheets

FLOATING PANEL MOUNT CONNECTOR ASSEMBLY

BACKGROUND OF THE INVENTION

1. Field of the Invention

The present invention generally relates to a connector assembly, and more particularly to a connector assembly which can be easily held for mounting on a panel in a floating manner.

2. Description of Related Art

Cable connector assemblies are widely used for signal or power transmission between personal computers and peripheral equipments. Such a cable connector assembly is usually needed to be mounted to a panel on which a plurality of connectors are arranged side by side to form a sub module.

U.S. Pat. No. 6,547,591 (U.S. Cl. 439/557, 558) discloses a panel-mounting connector with resilient retaining members latching to the panel. U.S. Pat. No. 6,017,233 (U.S. Cl. 439/248, 247) discloses a panel mounting connector with locking portions latching to floating retaining caps for performing the floating retention thereof. U.S. Pat. No. 6,210,215 (U.S. 439/545, 564) discloses a panel mounting connector assembled to the panel in an L-shaped moving path.

Hence, an improved panel mounted connector system is highly desired to obtain a convenient, easy, and reliable attachment with the panel.

SUMMARY OF THE INVENTION

Accordingly, an object of the present invention is to provide a floating panel mount connector assembly having a fixing pusher which is able to be easily held and safely mounted onto a panel by hands of an user.

In order to achieve the object set forth, a connector assembly in accordance with the present invention is adapted to floatable mount onto a panel having a mounting opening and a plurality of fitting openings therethrough, and comprises a housing having a plurality of keys formed on an upper surface and a lower surface thereof, a plurality of conductive contacts disposed in the housing, and a fixing pusher moveable attached to the housing along the first direction. The fixing pusher comprises a finger operable main body and a forwardly extending filling bar. The keys are adapted to pass through the corresponding fitting opening of the panel from one side along a first direction and engage with an opposite side of the panel after a movement of the housing relative to the panel along a second direction perpendicular to the first direction. The main body of the fixing pusher is pushed by a user without any other equipment to bring the filling bar into engagement with the panel, and thus easily safely mounts the connector assembly onto the panel in a floating manner.

Other objects, advantages and novel features of the invention will become more apparent from the following detailed description when taken in conjunction with the accompanying drawings.

DETAILED DESCRIPTION OF THE INVENTION

Figure 1:
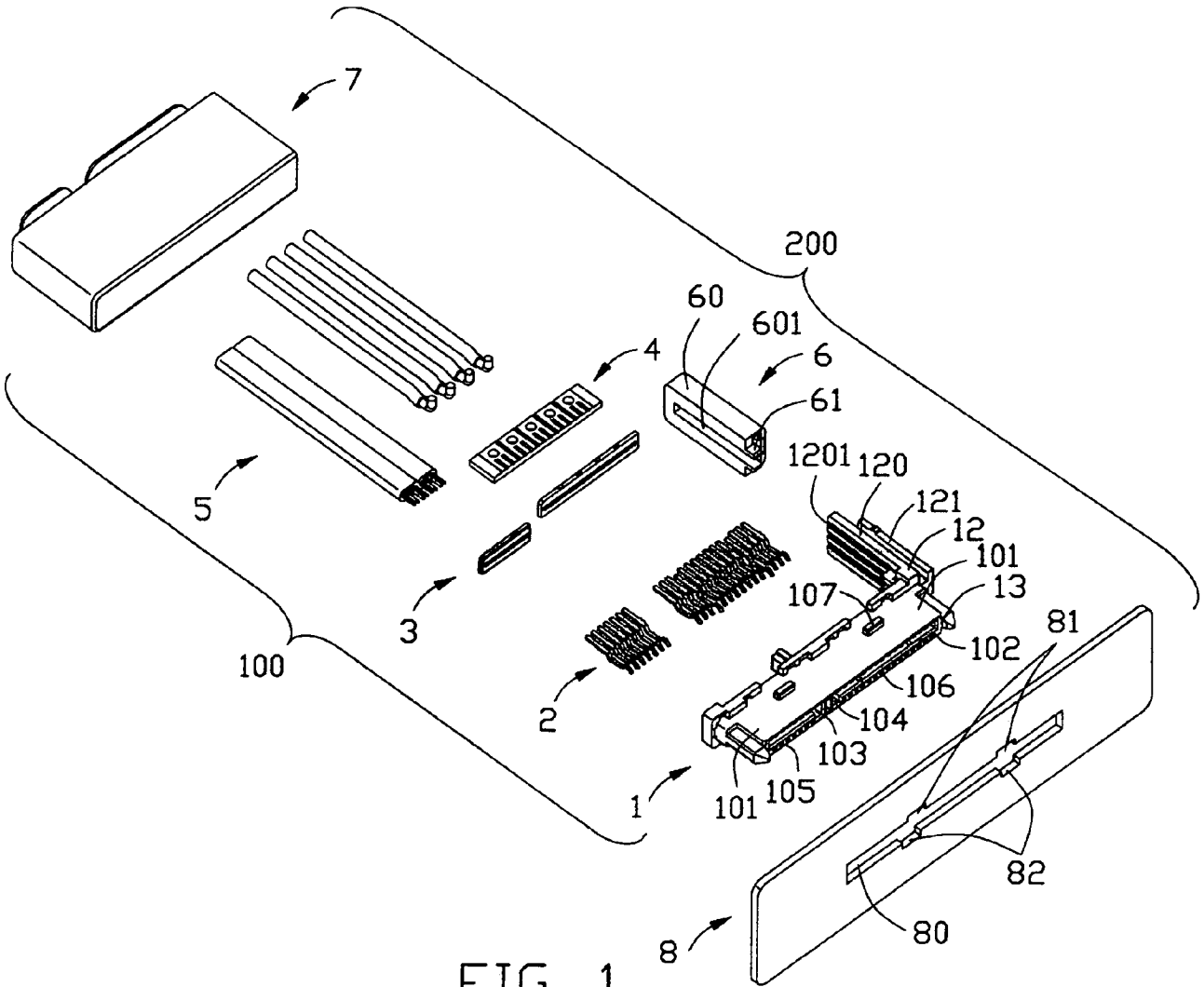
FIG. 1 is an exploded, perspective view of a connector assembly in accordance with one embodiment of the present invention and a panel.
Figure 2:
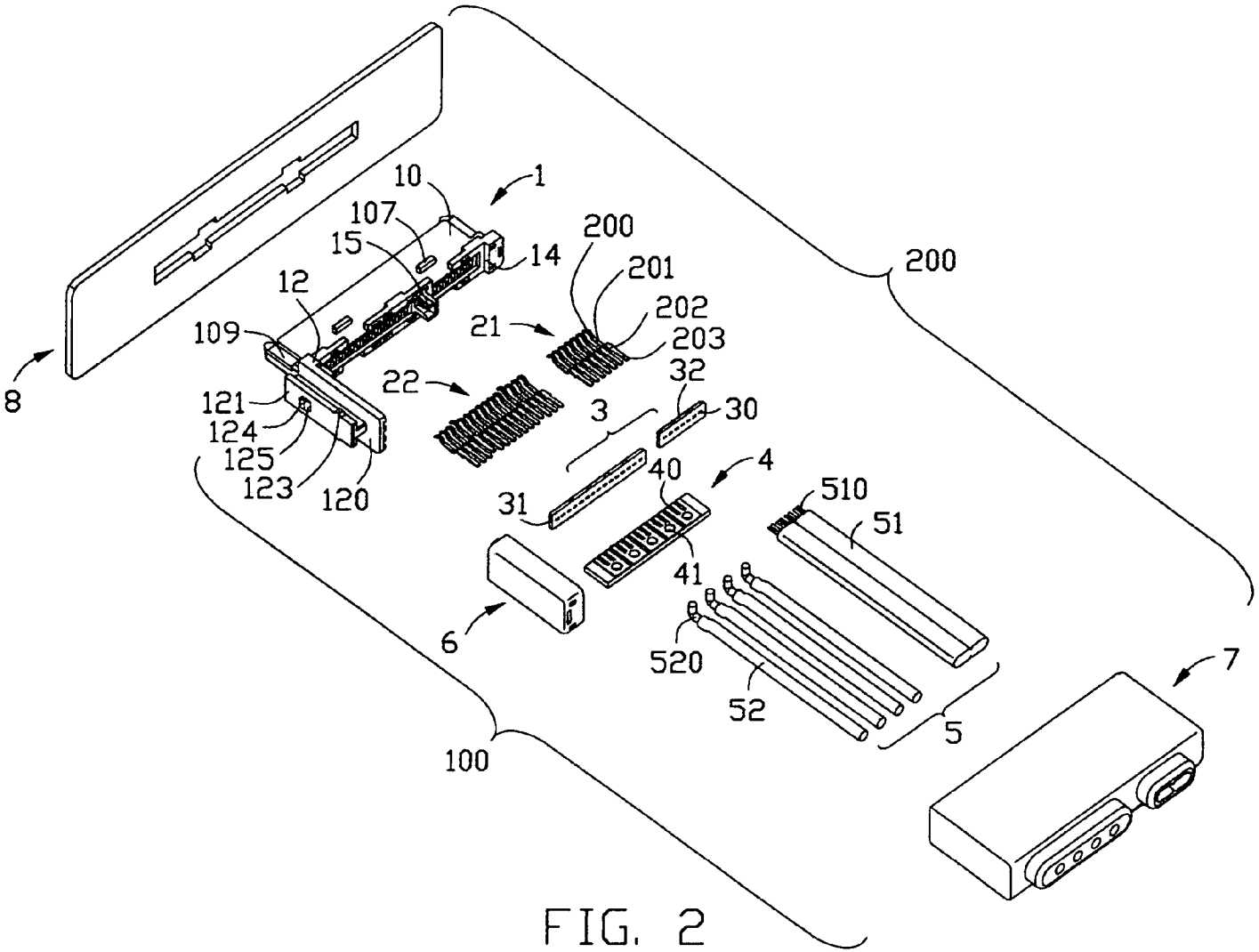
FIG. 2 is a view similar to FIG. 1, but taken from a different aspect.
Figure 3:
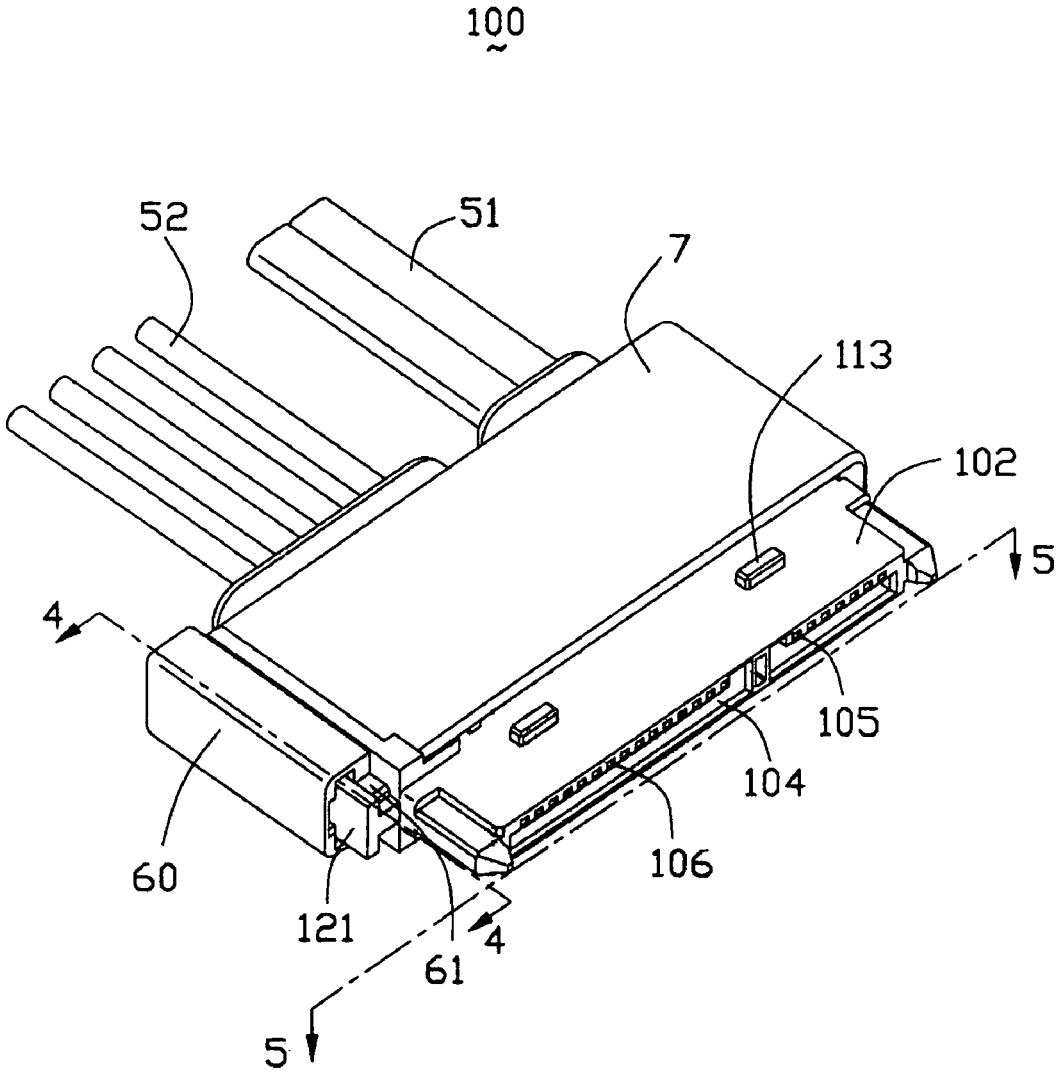
FIG. 3 is an assembled view of the connector assembly shown in FIG. 1 with a fixing pusher in FIG. 1 in a pre-seated state.

Reference will now be made in detail to the preferred embodiment of the present invention. Referring to FIG. 1 and FIG. 2, a connector assembly 100 in accordance with the present invention, which is mounted to a panel 8 to form a floating panel mount system 200, comprises an insulative housing 1, a plurality of conductive contacts 2 assembled to the housing 1, two spacers 3 assembled to the housing 1, a printed circuit board 4, a plurality of cables 5 electrically connected with the conductive contacts 2, a fixing pusher 6 attached to the housing 1 and a cover 6 assembled to the insulative housing 1.

The insulative housing 1 is substantially elongated and comprises a mating portion 10 forwardly extending and an arm/pier portion 12 rearwardly extending from one rear end of the mating portion 10. The housing 1 comprises a mating face 13 at a front end of the mating portion 10 and a terminating face 14 opposite to the mating face 13. The housing 1 also defines a front-to-back direction parallel to a mating direction of the connector assembly 100 and a longitudinal direction generally perpendicular to the front-to-back direction. The mating portion 10 comprises an upper wall 101, an opposite lower wall 102 and a partition wall 103 extending between the upper wall 101 and the lower wall 102 in the mating direction and thus, defining two L-shaped receiving spaces 104. The lower wall 102 defines a plurality of first passages 105 and a plurality of second passages 106 extending through the terminating face 14. A pair of first keys 107 and a pair of second keys 108 are respectively provided on outer surfaces of the upper wall 101 and the lower wall 102, and a distance between the pair of the first keys 107 is larger than that of the second keys 108 for polarization. A pair of guiding projections 109 outwardly extend from opposite side surfaces (not labeled) of the mating portion 10 for guiding a proper insertion of a complementary connector (not shown). The housing 1 further comprises a pair of supporting brackets 15 rearwardly extending from the terminating face 14 and bracketing rear openings (not labeled) of the second passages 106 therein.

The arm portion 12 of the housing 1 is composed of a flat plate 120 essentially connecting with the mating portion 10 and a leading portion 121 extending outwardly from the flat plate 120. The flat plate 120 defines a plurality of slots 1201 in an inner surface thereof for reliably securing to the cover 7 during overmolding the cover 7 with housing 1. The leading portion 121 comprises a pair of first protrusions 123 on opposite top and bottom surfaces thereof and a second protrusion 124 on most outer side surface thereof, and each protrusion 123, 124 defines a rearwardly inclined rear face 125. The pair of first protrusions 123 locates near a rear end of the leading portion 121. The second protrusion 124 locates near a front end of the leading portion 121.

The plural contacts 2 are divided into a first set 21 and a second set 22. The first set 21 is composed of seven contacts 2 used for transmitting signal. the second set 22 is composed of fifteen contacts 2 used for transmitting power. Each conductive contact 2 comprises a retention section 202, a mating section 201 extending from one end of the retention section 202 with a curved mating end 200 formed at a forward end thereof, and a tail section 203 extending from the other end of the retention section 202. Each spacer 3 is elongated and is made of insulative material. A plurality of through-holes 30 are defined through the spacers 3 corresponding to the first and second passages 105, 106.

The printed circuit board 4 has a plurality of soldering pads 40 on one edge thereof corresponding to the contacts 2 of the second set 22. A plurality of apertures 41 are defined near the other edge of the printed circuit board 4. In the preferred embodiment, the cable 5 comprises a first cable 51 having a plurality of first conductors 510 and a plurality of second cables 52. Each second cable 52 comprises a second conductor 520 in the center thereof.

Figure 4:
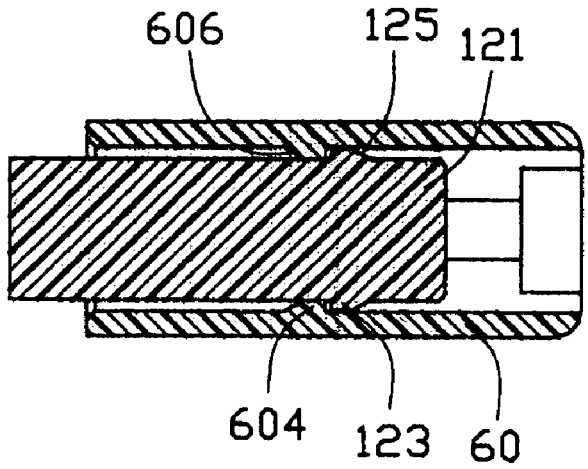
FIG. 4 a cross-sectional view of FIG. 3 taken along line 4—4.
Figure 7:
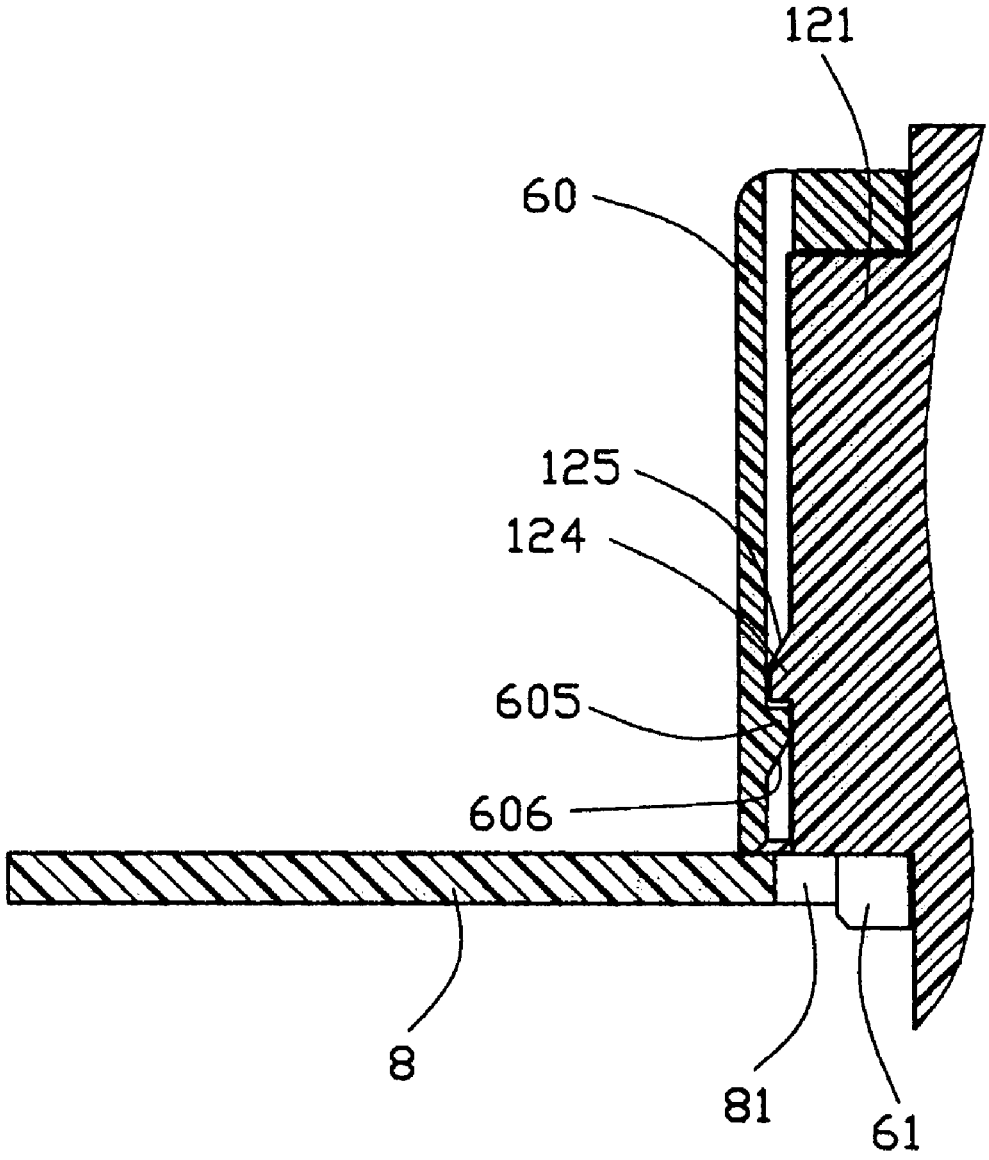
FIG. 7 a partially cut away sectional view of FIG. 6 taken along line 7—7.
Figure 8:
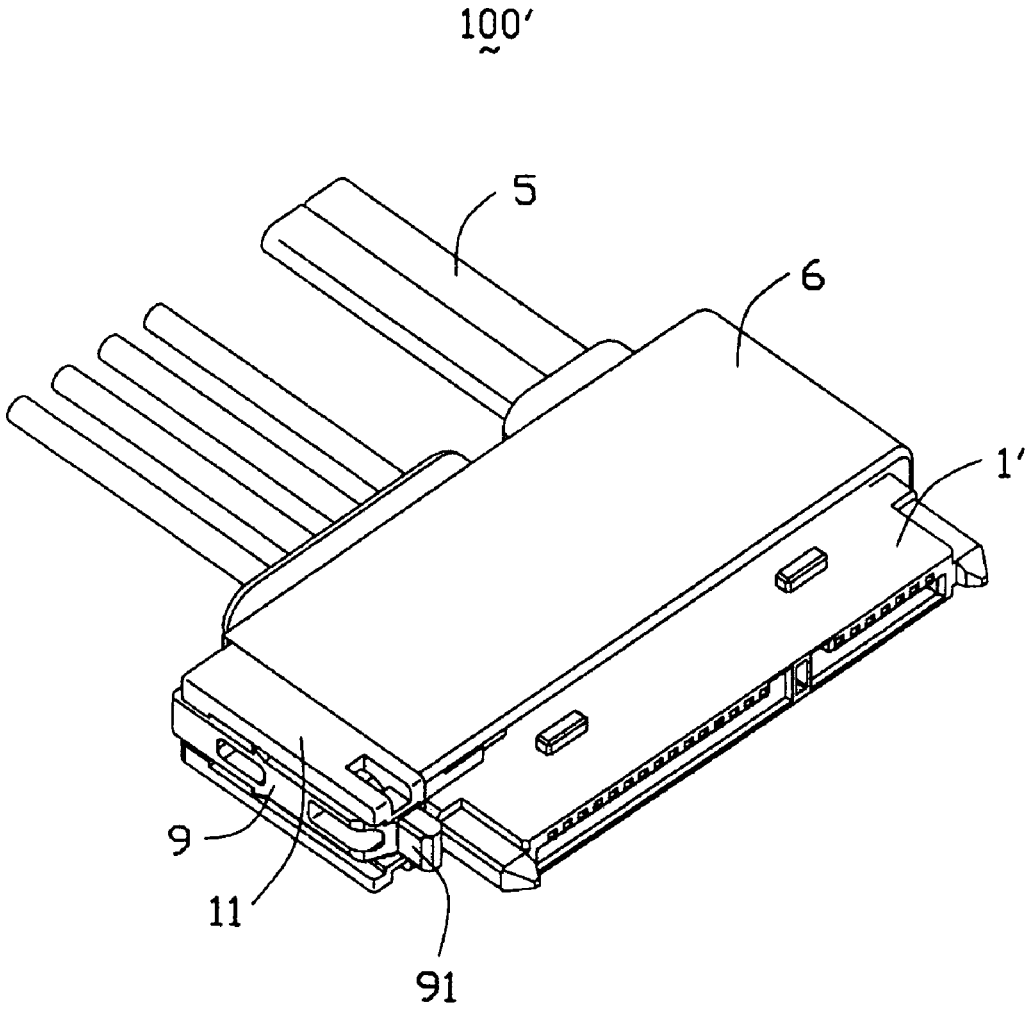
FIG. 8 is an assembled, perspective view of a connector assembly in accordance with a second embodiment of the present invention, with a fixing pusher in a final-seated state.
Figure 9:
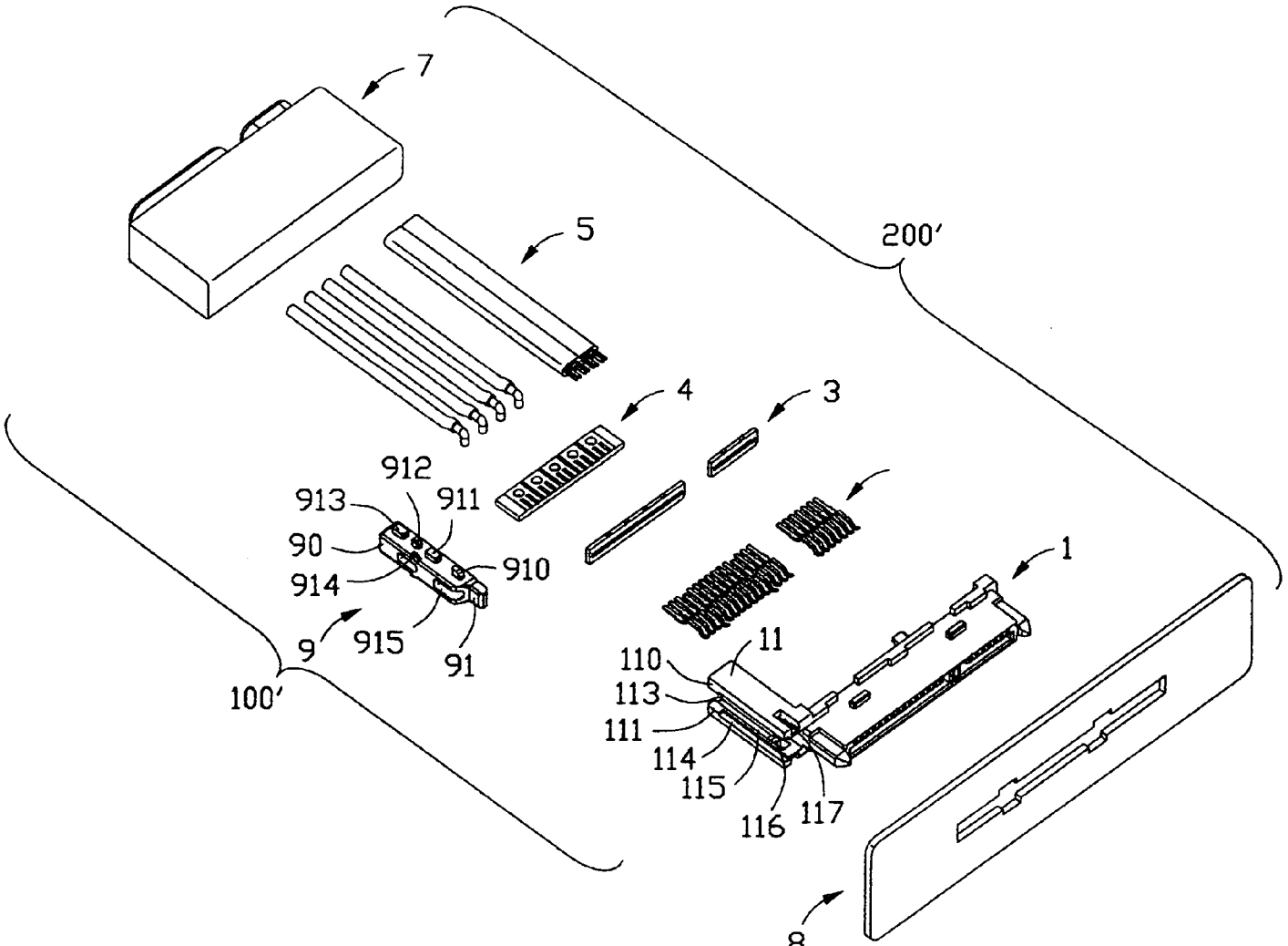
FIG. 9 is an exploded, perspective view of the connector assembly shown in FIG. 8 and the panel.
Figure 10:
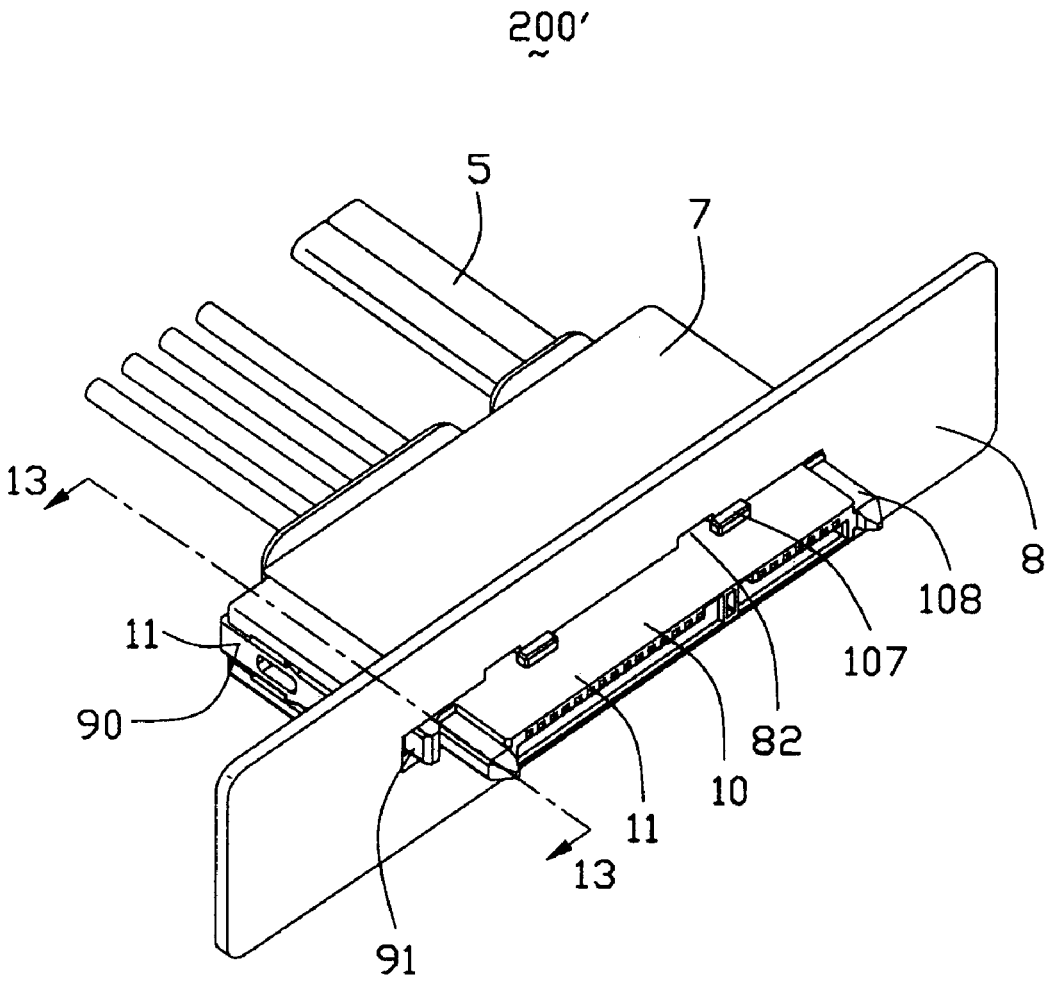
FIG. 10 is an assembled, perspective view of FIG. 9, showing the fixing pusher in a final-seated state.

Referring to FIGS. 1–2 and in conjunction with FIGS. 3–7, the fixing pusher 6 is formed with a box-shaped main body 60 and a pair of filling bars 61 forwardly extending from a front end of the main body 60. The main body 60 defines a T-shaped receiving opening 601 opened to one side near the housing 1 for moveable receiving the T-shaped leading portion 121 of the housing 1 (FIG. 4). The main body 60 further provides a pair of first stopping projections 604 on each rear inner surface thereof for respectively engaging with the first protrusions 123 and a second stopping projection 605 on forward side surface thereof. Each stopping projection 604, 605 defines an inclined front face 606 (FIG. 7).

The panel 8 is a rectangular board and defines a mounting opening 80 in a center thereof, and a pair of first and second fitting openings 81, 82 in communication with the mounting opening 81. The first and second fitting openings 81, 82 are respectively in alignment with the first and second keys 107, 108 of the housing 1 in the front-to-back direction.

Referring to FIGS. 1–2 in conjunction with FIGS. 3–7, in assembly, the contacts 2 of the first set 21 and the second set 22 are respectively inserted into the first passages 104 and the second passages 105 with the curved mating ends 200 of the mating sections 201 exposed into the receiving space 104. The retention sections 202 interferentially fit into corresponding passages 104, 105 for securing the conductive contacts 2 to the insulative housing 1. The spacers 3 are assembled to the insulative housing 1 with the tail portions 203 of the contacts 2 passing through corresponding through-holes 30 thereof. The printed circuit board 4 is embraced between the pair of supporting brackets 15 with soldering pads 40 thereon electrically connecting with the contacts 2 of the second set 22. The first conductors 510 of the first cable 51 are respectively electrically connected with the tail sections 203 of contacts 2 of the first set 21 by conventional means. The second conductors 520 of the second cables 52 are respectively inserted into corresponding apertures 41 of the printed circuit board 4, thereby forming an electrical connection between the second cables 52 and the contacts 2 of the second set 22.

Figure 5:
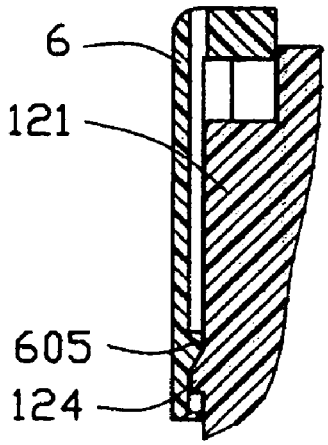
FIG. 5 is a partially cut away sectional view of FIG. 3 taken along line 5—5.
Figure 6:
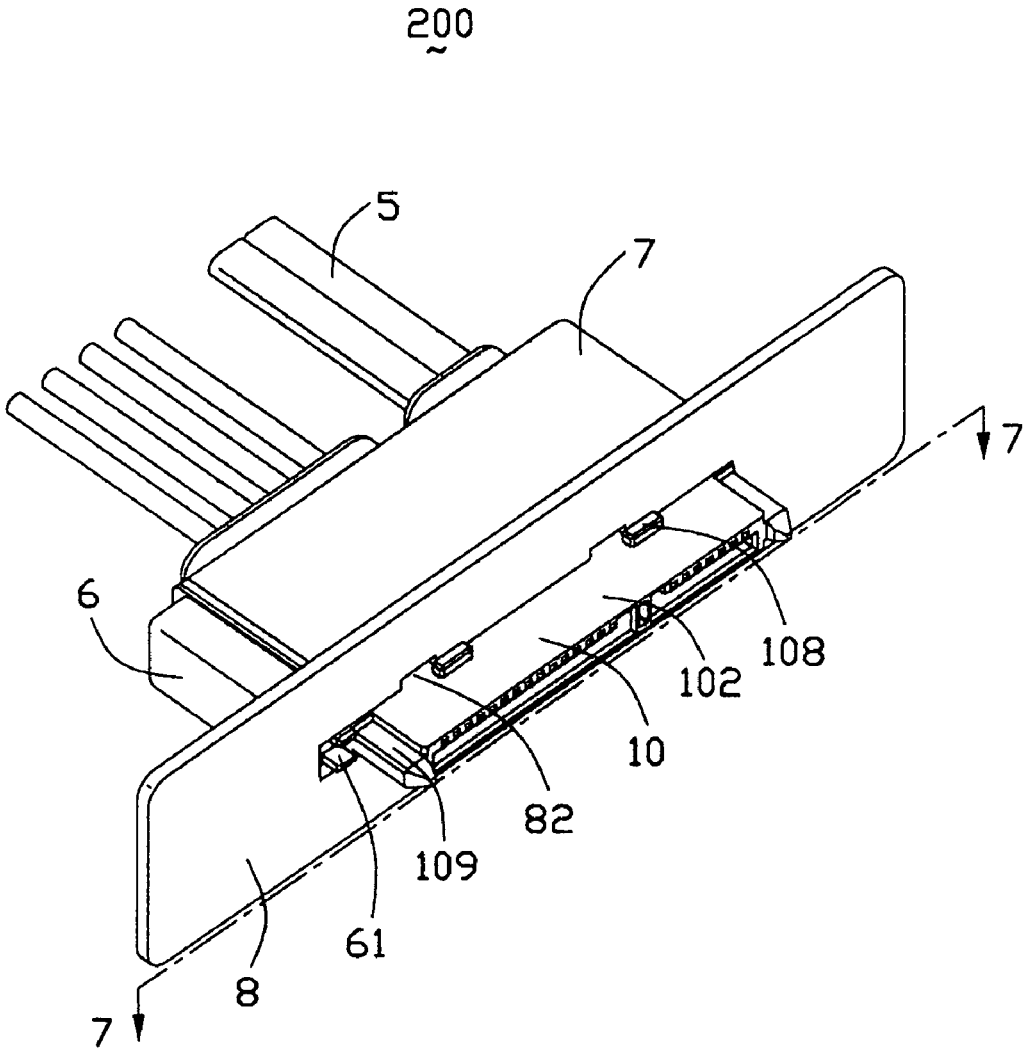
FIG. 6 is an assembled, perspective view of FIG. 1, showing the fixing pusher in a final-seated state.

Particularly referring to FIGS. 3–5 and 7, the fixing pusher 6 is attached to the housing 1 along a rear-to-front direction in a pre-seated state. In this state, the leading portion 121 of the housing 1 is partially received in the receiving opening 601, the first stopping projections 604 of the fixing pusher 6 are respectively pushed over the corresponding first protrusions 123 to lock with each other, with the second stopping projection 605 being not in contact with the second protrusion 124 (FIG. 5). Thus, a rearward movement of the fixing pusher 6 is limited by the first protrusions 123 when it is in the pre-seated state. As the leading portion 121 is substantially T-shaped, the fixing pusher 6 will not rotate about an axis in the rear-to-front direction. Finally, the insulative cover 7 is molded with the inner side of the flat plate 120, the rear end of the housing 1 and joint portions of the contacts 2 and the cables 5, thus, the connector assembly 100 is obtained.

Referring to FIGS. 1–7, when the connector assembly 100 is assembled to the panel 8, the mating portion 10 and the pair of guiding projections 109 extend through the mounting opening 80 until a front end of the arm portion 12 abuts against a rear side of the panel 8. The first and second keys 107, 108 respectively pass through corresponding first and second fixing openings 81, 82. The connector assembly 100 is then moved relative to the panel 8 in the longitudinal direction until keys 107, 108 abutting against a front side of the panel 8. The fixing pusher 6 is further forwardly pushed until the filling bars 61 at its forward are brought into mounting opening 80 of the panel 8, thereby mounting the connector assembly 100 onto the panel 8 in a floating manner. Further, this is a final-seated state of the fixing pusher 6 with the second stopping projection 605 thereof being pushed over the second protrusion 124 to lock with second protrusion 124. Thereafter, a rearward movement of the fixing pusher 6 is limited by the second protrusion 124 in this state.

Referring to FIGS. 8–13, another preferable embodiment of the present invention is shown. The arm portion 11 comprises a top wall 110, an opposite bottom wall 111 and a receiving channel 113 defined therethrough between the top wall 110 and the bottom wall 111. Both the top wall 110 and the bottom wall 111 of the arm portion 11 define a first slot 114 at the most outer side thereof with a rear end face thereof in front of an end of the arm portion 11. A recess 115 inwardly recessing from inner surface thereof with a forward end thereof behind a front end of the arm portion 11 and a top opened cutout 117 in communication with the recess 115. The arm portion 11 further forms a forward portion 116 on the forward end of the recess 115 protruding toward the receiving channel 113.

The fixing pusher 9 comprises a main body 90 and a filling bar 91 forwardly extending from the main body 90. Both upper and lower surfaces of the main body 90 have a second stopper 910, a first block 911, a fitting block 912 and a second block 913 thereon, which are arranged in a row along the front-to-back direction. A pair of first stoppers 914 is formed at the most outer side of the main body 90. Two spaced grooves 915 are defined through the main body 90 for providing deforming space of the second stoppers 910 and the fitting block 912 when the fixing pusher 9 is attached to the housing 1'.

Figure 11:
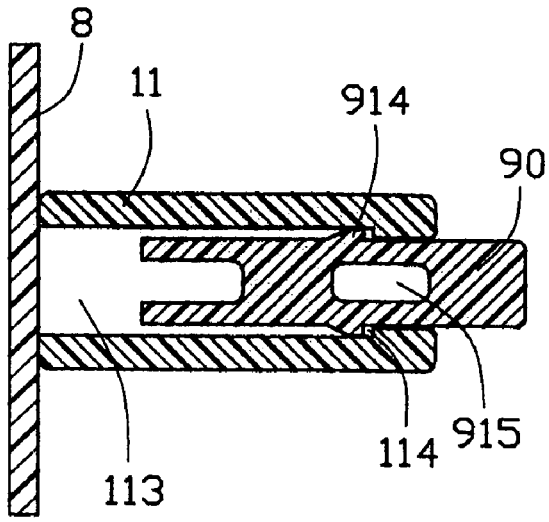
FIGS. 11 and 12 are cross-sectional views showing the fixing pusher in a pre-seated state.
Figure 12:
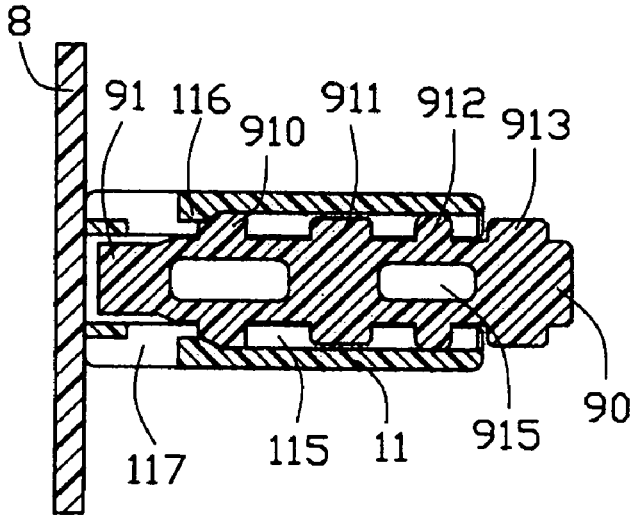
Figure 13:
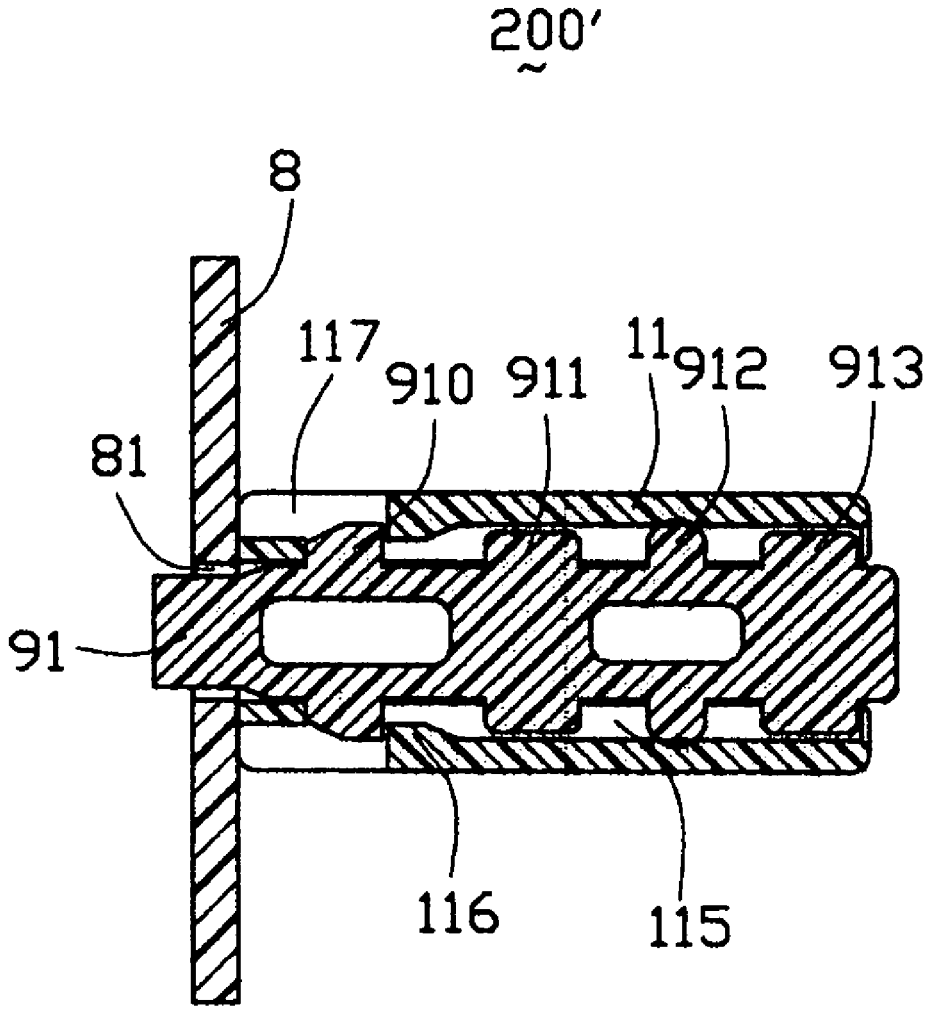
FIG. 13 is a cross-sectional view of FIG. 10 taken along line 13—13.

Particularly referring to FIGS. 11–13, when the electrical connector 100 is mounted onto the panel 8, the fixing pusher 9 is firstly assembled to the housing 1' in the rear-to-front direction. The first stoppers 914 respectively interferentially slide into the first slots 114 and front ends of the second stoppers 910 respectively abut against the forward ends of the recesses 115, thus, the fixing pusher 9 is in a first state that it cannot be rearwardly moved. Then, the housing 1' is inserted into the mounting opening 80 of the panel 8 with keys 107, 108 thereon passing through corresponding fitting openings 81, 82 of the panel 8. Thereafter, the electrical connector 100' is moved relative to the panel 8 in the longitudinal direction to bring the keys 107, 108 into abutment against the panel 8. Finally, the fixing pusher 9 is further pushed into engagement with the arm portion 11 of the housing 1' until the filling bar 91 is brought into the mounting opening 80. This is a second state of the fixing pusher 9 that the second stoppers 910 thereof slid over the forward portions 116 of the arm 11 and further protrude into the opened cutouts 117 with rear ends thereof stopped by the forward portion 116 for preventing a rearward movement. In this way which is essentially similar to that of the first embodiment of the present invention, the connector assembly 100' is mounted onto the panel 8 in a floating manner to form the floating panel mount system 200'.

It should be noted that, since the fixing pushers 6, 9 are made of insulative material and configured in a box-shape, they are enable to be held and operated by hands of an user without worrying about being inadvertently injured. Of course, there is no need of an additional device used for putting the fixing pusher 6, 9 into engagement with the housing 1 and the panel 8.

Figure 14:
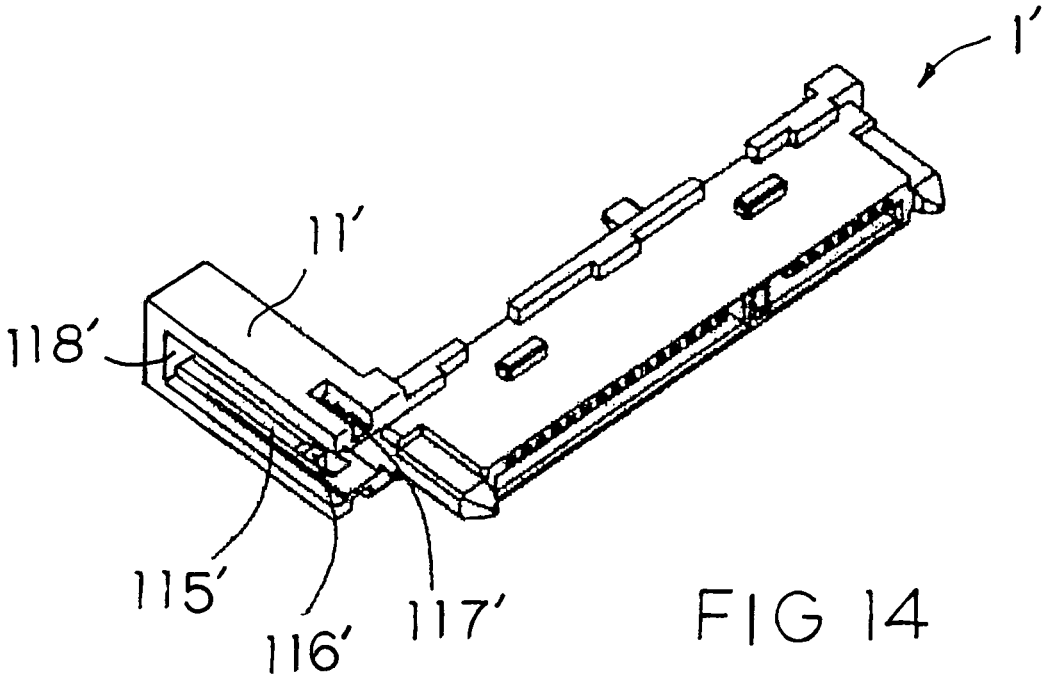
FIG. 14 is a perspective view showing the housing for use with a third embodiment of the invention.
Figure 15:
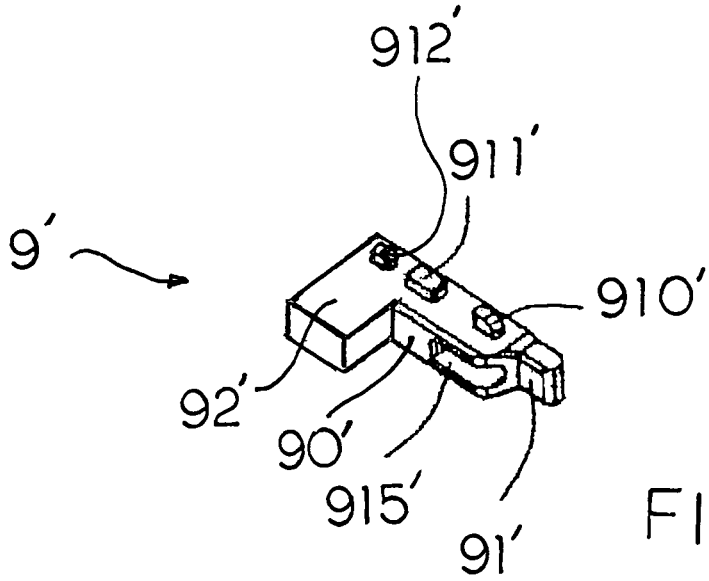
FIG. 15 is a perspective view showing the fixing pusher for use with the third embodiment of FIG. 14.
Figure 16:
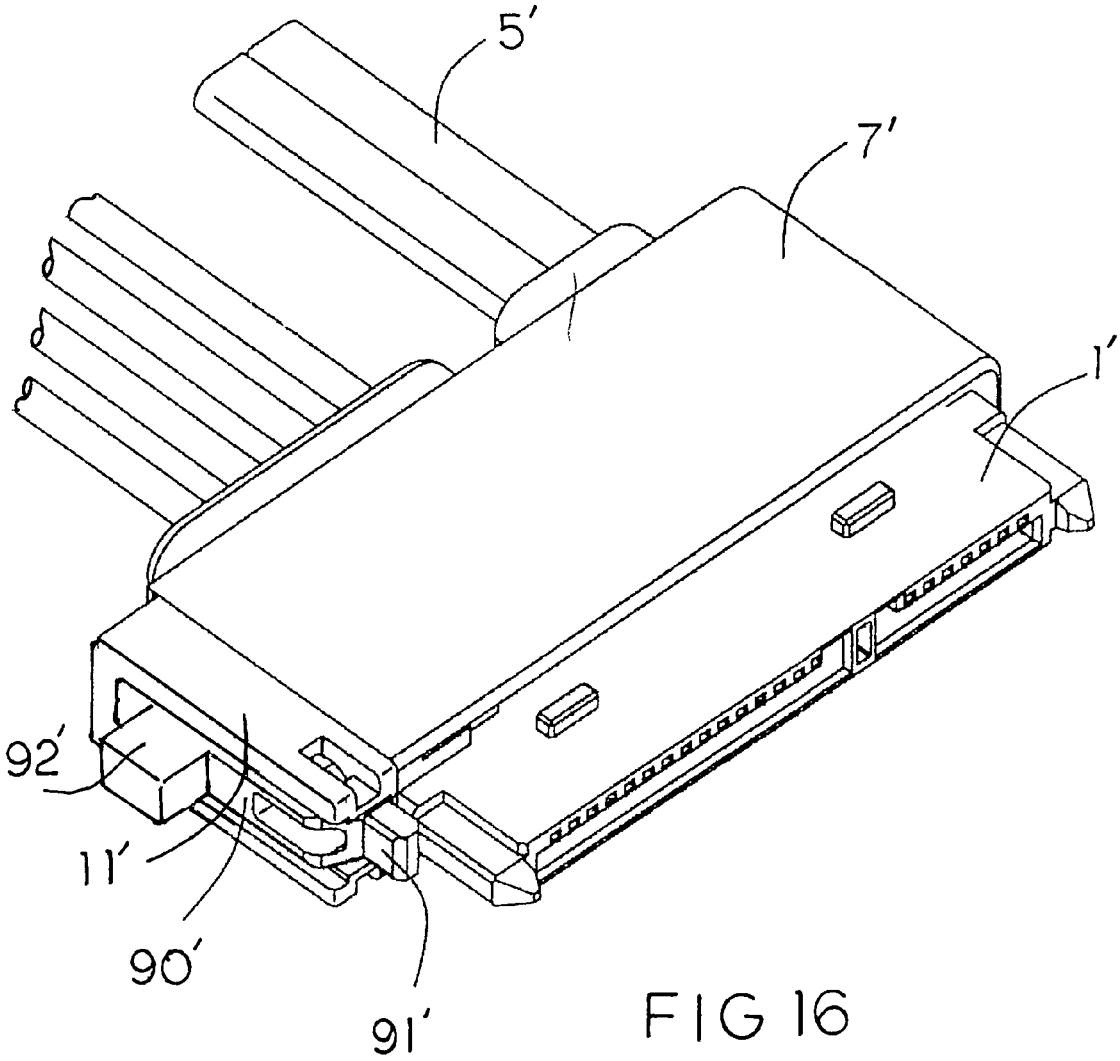
FIG. 16 is a perspective view showing the assembled housing and fixing pusher.

FIGS. 14–16 show a third embodiment of the invention similar to the second embodiment, wherein the arm portion 11' of the housing 1' has the recess 115' communicating with the cutout 117' and the forward portion 116', and a stopper support 118' at the rear end of the recess 115', and wherein the fixing pusher 9' has a main body 90' with a stopper 910', the first block 911' and a fitting block 912' on one surface, a fitting bar 91' at a front end, a groove 915' in a middle portion, and a handle 92' extending outwardly in a lateral direction perpendicular to the longitudinal direction of the main body 90'. When the fixing pusher 9' is located in a retracted (rearward) position where the fitting bar 91' is not effectively located in the mounting opening 80, the rear face of the handle 92' is seated upon the stopper support 118' for preventing rearward movement of the fixing pusher 9' relative to the arm portion 11', and the stopper 910' abuts against the forward portion 116' for preventing forward movement of the fixing pusher 9' relative to the arm portion 11'; when the fixing pusher 9' is located in an extended (forward) position where the fitting bar 91' is effectively located in the mounting opening 80, the stopper 910' is essentially restrictively located in the cutout 117'.

It can be noted that especially in the first and third embodiments, the fixing pusher is easily accessibly operated from an exterior in a lateral direction rather than and perpendicular to the longitudinal direction of the arm portion, so the operation of the fixing pusher is more controllably friendly for assembling.

Figure 17:
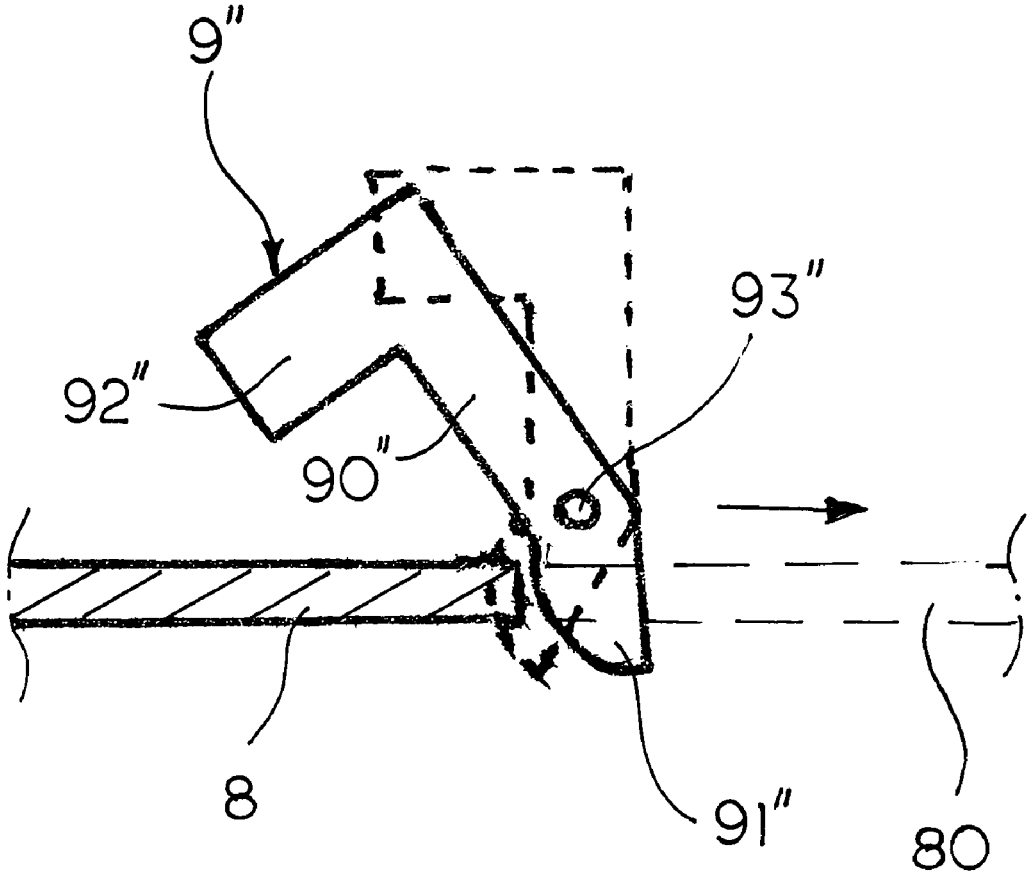
FIG. 17 is an illustrating view showing a rotatable fixing pusher for use with a fourth embodiment of the invention.

Similar to the third embodiment using an L-shaped fixing pusher 9', FIG. 17 shows an L-shaped fixing/actuating lever 9" which is rotatably fixed to the arm portion (not shown) about the pivot 93" wherein the cam fitting bar 91" is located at a front end of the main body 90" and the handle 92" is located at a rear end of the main body 90". The fixing/actuating lever 9" with the associated arm portion of the housing (not shown) initially approaches the mounting panel 8 with the fitting bar 91" somewhat invading the mounting opening 82 and with the main body 90" in an oblique manner (as shown in the solid lines), and successively rotates to have the main body 90" essentially parallel to the housing (as shown in the dashed lines) so as to have the cam fitting bar 91" push away the panel 8, rendering a reaction force resulting in the movement of the whole connector housing in a longitudinal direction of the mounting opening along the shown arrow.

Under this situation, the fixing/actuating lever 9' performs not only the fixing function as provided by the foregoing first, second and third embodiments, but also the actuating function to move the whole connector housing in a longitudinal direction of the mounting opening for offsetting the keys and the fixing openings in the front-to-back direction. In other words, in the first, second and third embodiments the L-shaped moving path of the housing (including the forward and lateral movements) is finished before the fixing pusher is moved; differently, in the fourth embodiment only the forward movement of such an L-shaped movement path is required to be finished before the fixing/actuating lever is operated because the fixing/actuating lever results in the lateral movement of such an L-shaped movement path. Understandably, this pivotal arrangement and the associated advantage are essentially derived from the lateral accessibility/operability of the fixing pusher.

It is also noted that referring to FIG. 13, in the second embodiment the second stopper 910 can be depressed downward through the cutout 117 from the exterior for disengagement from the cutout 17, rendering backward movement of the fixing pusher 9 for easily releasing the connector 100' from the panel 8. This easy accessibility and operation makes it convenient to assembly or disassemble the connector 100' with regard to the panel 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly adapted to be mounted onto a panel having opening means therethrough, comprising:

a housing comprising at least one key formed on each of an upper surface and a lower surface thereof adapted to pass through the opening means of the panel from one side along a first direction and engage with an opposite side of the panel after a movement of the housing relative to the panel along a second direction perpendicular to the first direction;

a plurality of conductive contacts disposed in the housing;

a fixing pusher moveable attached to the housing along the first direction, comprising a finger operable main body and a forwardly extending filling bar, after the movement of the housing in the second direction, the main body further directly pushed by a user without any other equipment to bring the filling bar into engagement with the panel, wherein the housing comprises a rearwardly extending arm portion, and the fixing pusher is attached to the arm portion;

the arm portion of the housing has a first protrusion near a rear end thereof, and the main body of the fixing pusher forms a first projection to lock with the first protrusion of the housing for limiting a rearward movement of the fixing pusher along the first direction; and the arm portion of the housing has a second protrusion near a front end thereof, and wherein the main body of the fixing pusher forms a second projection to lock with the second protrusion of the housing for limiting a rearward movement of the fixing pusher along the first direction, after the movement of the housing in the second direction.

2. The connector assembly as claimed in claim 1, wherein the at least one key comprises a pair of first keys on an upper surface and a pair of second keys on an lower surface of the housing, and a distance between the pair of first keys is larger than that of the second keys.

3. The connector assembly as claimed in claim 1, wherein the arm portion of the insulative housing comprises an outwardly extending leading portion, and wherein the fixing pusher defines a receiving opening opened to one side near the housing to moveable receive the lead portion therein.

4. The connector assembly as claimed in claim 1, wherein the leading portion of the housing and the receiving opening of the fixing pusher are T-shaped for preventing a rotation about an axis in the first direction.

5. The connector assembly as claimed in claim 1, wherein the arm portion of the insulative housing defines a receiving channel in the first direction moveable receiving the main body of the fixing pusher.

6. The connector assembly as claimed in claim 1, wherein the housing comprises a forwardly extending mating portion in front of the arm portion adapted to pass through the panel and move along the second direction.

7. The connector assembly as claimed in claim 6, wherein the housing comprises a pair of guiding projections extending outwardly from opposite side surfaces of the mating portion.

8. The connector assembly as claimed in claim 1, wherein the contacts are divided into two sets, and wherein the insulative housing defines a plurality of first passages and a plurality of second passages to respectively receive the conductive contacts of the first and second sets.

9. The connector assembly as claimed in claim 8, further comprising cable connected with the contacts.

10. The connector assembly as claimed in claim 9, wherein the connector assembly has a printed circuit board electrically connected to conductive contacts of the second set, and wherein the cable is composed of a first cable having a plurality of conductors electrically connected to corresponding contacts of the first set and a plurality of second cables each having a conductor and electrically connected to the contacts of the second set via the printed circuit board.

11. The connector assembly as claimed in claim 10, wherein the housing forms a pair of supporting brackets at a rear side thereof, and wherein the printed circuit board is embraced between the supporting brackets in a supported manner.

12. The connector assembly as claimed in claim 1 comprising a cover secured to and partially enclosing the housing.

13. An panel mounting connector assembly comprising:

a mounting panel defining a mounting opening therethrough in a front-to-back direction, a fixing opening communicatively located beside said mounting opening;

an electrical connector including:

an insulative housing defining a mating portion being little bit smaller than the mounting opening and an arm portion at one lengthwise end of the mating portion, a key formed on the mating portion compliant with said fixing opening;

a plurality of contacts disposed in the housing;

a plurality of wires located proximate a rear portion of the housing and electrically connected to the contacts; and a fixing pusher associated with said arm portion and being greatly laterally accessible and operable from and exposed to an exterior, said fixing pusher having a fitting bar at a front end thereof;

said housing forwardly moved and engaged within the mounting opening under a condition the key initially aligned with and successively passing the fixing opening, and said housing further successively laterally moved in a lateral direction to have said key and said fixing opening offset from each other, thereby preventing the housing from rearward moving; wherein said fixing pusher is forwardly moved to have said fitting bar forwardly extending through the mounting panel, thus preventing the housing from moving in another lateral direction opposite to said lateral direction, wherein said fixing pusher defines an L-shaped configuration with a handle at a rear end extending outwardly and laterally beyond the arm portion for easy access/operation.

14. The assembly as claimed in claim 13, wherein said fitting bar invades the mounting opening when said fixing pusher is forward moved.

15. The assembly as claimed in claim 13, wherein said fixing pusher essentially circumferentially grasps the arm portion.

16. An electrical panel mounting connector assembly comprising:

a mounting panel defining a mounting opening therethrough in a front-to-back direction, a fixing opening located adjacent said mounting opening;

an electrical connector including:

an insulative housing defining a mating portion being little bit smaller than the mounting opening and a pier portion at one lengthwise end of the mating portion, a key formed proximate the mating portion compliant with said fixing opening;

a plurality of contacts disposed in the housing;

a plurality of wires located proximate a rear portion of the housing and electrically connected to the contacts; and a fixing device associated with said pier portion and being accessible and operable from an exterior, said fixing device having a fitting bar at a front end thereof;

said housing forwardly moved and engaged within the mounting opening in a first direction under a condition the key initially aligned with and successively passing the fixing opening, and said housing further successively laterally moved in a second direction perpendicular to said first direction to have said key and said fixing opening offset from each other in said first direction, thereby preventing the housing from rearward moving; wherein said fixing device is moved to have said fitting bar extending through and engageable with the mounting panel, thus preventing the housing from moving in a third direction opposite to said second direction, wherein the fixing device is greatly laterally accessible and operable from and exposed to the exterior, and wherein the fixing device is pivotally mounted to the pier portion.

17. The connector assembly as claimed in claim 16, wherein said fixing device is moved in the first direction after said housing has been moved in both said first and second direction.

18. The connector assembly as claimed in claim 16, wherein said fixing device is pivotally moved to result in movement of the housing in said second direction.

* * * * *